US008967266B2

(12) United States Patent
Parlin et al.

(10) Patent No.: US 8,967,266 B2
(45) Date of Patent: Mar. 3, 2015

(54) PROTECTION OF CASING LOWSIDE WHILE MILLING CASING EXIT

(75) Inventors: Joseph DeWitt Parlin, Plano, TX (US); Espen Dahl, Stavaweir (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/825,582

(22) PCT Filed: Feb. 24, 2012

(86) PCT No.: PCT/US2012/026508

§ 371 (c)(1),
(2), (4) Date: Sep. 5, 2014

(87) PCT Pub. No.: WO2013/126070

PCT Pub. Date: Aug. 29, 2013

(65) Prior Publication Data

US 2015/0007993 A1 Jan. 8, 2015

(51) Int. Cl.

| | |
|---|---|
| ***E21B 7/08*** | (2006.01) |
| ***E21B 7/06*** | (2006.01) |
| ***E21B 17/04*** | (2006.01) |
| ***E21B 29/06*** | (2006.01) |

(52) U.S. Cl.
CPC ..... *E21B 7/061* (2013.01); *E21B 17/04* (2013.01); *E21B 29/06* (2013.01)
USPC ..... 166/313; 166/117.5

(58) Field of Classification Search
USPC ..... 166/313, 342, 50, 52, 117.5, 117.6
See application file for complete search history.

(56) References Cited

U.S. PATENT DOCUMENTS

| | | | | |
|---|---|---|---|---|
| 5,725,060 | A * | 3/1998 | Blount et al. | 175/61 |
| 5,727,629 | A | 3/1998 | Blizzard, Jr. et al. | |
| 5,875,847 | A * | 3/1999 | Forsyth | 166/313 |
| 6,182,760 | B1 * | 2/2001 | Phelps | 166/313 |
| 2003/0192717 | A1 | 10/2003 | Smith et al. | |
| 2007/0221380 | A1 * | 9/2007 | Restarick et al. | 166/313 |
| 2009/0314492 | A1 | 12/2009 | Reid et al. | |
| 2010/0012322 | A1 * | 1/2010 | McGarian | 166/298 |

FOREIGN PATENT DOCUMENTS

| | | |
|---|---|---|
| WO | WO 98/09053 A2 | 3/1998 |
| WO | 2013126070 A1 | 8/2013 |

OTHER PUBLICATIONS

International Search Report and Written Opinion for PCT/US2012/026508 dated Jan. 29, 2013.

* cited by examiner

*Primary Examiner* — William P Neuder
(74) *Attorney, Agent, or Firm* — McDermott Will & Emery LLP; Alan Bryson

(57) ABSTRACT

The lowside of a casing joint is protected from wear while milling a casing exit for a lateral borehole. The casing joint is coupled to a casing string and is made of a material that is softer than that of the casing string. A whipstock assembly is arranged within the casing joint and has a deflector surface operable to direct a drilling assembly into a sidewall of the casing joint to create the casing exit. A wear sleeve is coupled to and extends axially from the whipstock assembly, the wear sleeve defining a throat that extends axially along the axial length of the wear sleeve and transitions into the deflector surface. The axial length of the wear sleeve extends beyond a point of contact where the drilling assembly would otherwise engage the lowside of the casing joint.

23 Claims, 5 Drawing Sheets

PROTECTION OF CASING LOWSIDE WHILE MILLING CASING EXIT

BACKGROUND

The present invention relates generally to milling a casing exit for a lateral borehole, and more particularly to systems and methods of protecting the lowside of the casing from wear while milling a casing exit for a lateral borehole.

Hydrocarbons can be produced through relatively complex wellbores traversing a subterranean formation. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first general direction and a secondary wellbore diverted from the main wellbore in a second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed by positioning a casing joint and a whipstock in a casing string at a desired location in the main wellbore. The whipstock is used to deflect one or more mills laterally (or in an alternative orientation) relative to the casing string. The deflected mill(s) penetrates part of the casing joint to form the casing exit in the casing string. Drill bits can be subsequently inserted through the casing exit in order to cut the lateral or secondary wellbore.

While milling the casing exit, however, and during drilling of the subsequent lateral wellbore, significant wear can result on the lowside of the parent wellbore casing at or near the tip of the whipstock. The wear on the lowside of the wellbore is partly generated by the mills as a reactive force while cutting the exit in the casing or while trying to exit into the formation. Considerable wear is also generated by the drill pipe as it lays and rotates on the lowside of the parent wellbore at or near the tip of the whipstock.

In applications where the casing joint is made of softer casing materials, such as aluminum, the resulting wear can be significant. However, in instances where it is difficult for the casing exit to be milled, or there is a significant amount of time spent rotating the drill pipe at or near the tip of the whipstock, there can be significant wear even in steel casing (e.g., low alloy steel or 13Cr). This wear oftentimes results in the formation of a ledge on the inner surface of the casing which can cause problems with other bottom hole assemblies (BHAs) transversing the whipstock and entering the lateral borehole. The damaging wear can also create problems when trying to recover the whipstock, or it could create problems for subsequent operations below the milled casing exit after the whipstock has been recovered.

Previous attempts to prevent wear on the lowside of the wellbore have focused on reducing friction with the introduction of drilling fluids or drill pipe centralizers. The success of friction reducers in drilling fluids, however, can be costly and may be environmentally prohibited depending on geographic location. Moreover, the use of centralizers can vastly increase operational time as the centralizers must be added to each stand, thereby greatly increasing trip-in time.

SUMMARY OF THE INVENTION

The present invention relates generally to milling a casing exit for a lateral borehole, and more particularly to systems and methods of protecting the lowside of the casing from wear while milling a casing exit for a lateral borehole.

In some embodiments, a well system subassembly is disclosed. The subassembly may include a casing joint coupled to a casing string and defining a lowside therein. The casing joint may be made of a first material that is softer than that of the casing string. The subassembly may also include a whipstock assembly arranged within the casing joint and having a deflector surface operable to direct a drilling assembly into a sidewall of the casing joint to create a casing exit. The subassembly may further include a wear sleeve coupled to and extending axially from the whipstock assembly. The wear sleeve may define a throat that extends along an axial length of the wear sleeve and transitions into the deflector surface. The axial length of the wear sleeve may extend across a point of contact where the drilling assembly would otherwise engage the lowside of the casing joint, whereby the wear sleeve protects the lowside of the casing joint from wear caused by the drilling assembly.

In some embodiments, a method for protecting a lowside of a casing joint coupled to a casing string is disclosed. The method may include arranging within the casing joint a whipstock assembly having a deflector surface. The casing joint may be made of a material that is softer than that of the casing string. The method may also include arranging a wear sleeve axially adjacent and coupled to the whipstock assembly. The wear sleeve may define a throat that extends along an axial length of the wear sleeve and transitions into the deflector surface. The method may further include directing with the throat and deflector surface a drilling assembly into a sidewall of the casing joint to create a casing exit within the casing joint, and protecting with the wear sleeve the lowside of the casing joint from wear caused by the drilling assembly as the drilling assembly rotates. The axial length of the wear sleeve may extend across a point of contact where the drilling assembly would otherwise engage the lowside.

In some embodiments, another well system subassembly is disclosed. The subassembly may include a casing joint coupled to a casing string and defining a lowside therein. The casing joint may be made of a first material that is softer than that of the casing string. The subassembly may also include a whipstock assembly arranged within the casing joint and having an uphole tip and a deflector surface operable to direct a drilling assembly into a sidewall of the casing joint to create a casing exit. The subassembly may further include a wear bushing coupled to the drilling assembly and removable from the drilling assembly upon engaging a stationary wellbore object. The wear bushing may be configured to protect the lowside of the casing joint from damaging wear caused by the drill string assembly.

In some embodiments, another method for protecting a lowside of a casing joint coupled to a casing string is disclosed. The method may include arranging within the casing joint a whipstock assembly having an uphole tip and a deflector surface. The casing joint may be made of a material that is softer than that of the casing string. The method may also include advancing a drilling assembly within the casing string, the drilling assembly having a wear bushing coupled thereto, and disengaging the wear bushing from the drilling assembly by contacting the wear bushing with a stationary wellbore object. The method may further include directing with the deflector surface a drilling assembly into a sidewall of the casing joint to create a casing exit within the casing joint, and protecting with the wear bushing the lowside of the casing joint from wear caused by the drilling assembly as the drilling assembly rotates. The wear bushing may have an axial length that extends across a point of contact where the drilling assembly would otherwise engage the lowside.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates generally to milling a casing exit for a lateral borehole, and more particularly to systems and methods of protecting the lowside of the casing from wear while milling a casing exit for a lateral borehole.

The present invention provides systems and methods for reducing wear on casing joints where a casing exit or window is to be drilled into a casing string in order to form a lateral or a secondary borehole. The disclosed embodiments may be particularly advantageous for use with recently developed casing joints made from softer materials, such as aluminum. While softer casing joints allow the casing exit to be created or milled more easily, substantial wear on the casing joint often results. The disclosed embodiments may be configured to protect softer casing joints from this damaging wear. The present invention also reduces wear damage that may result on the casing string as caused by drill pipe contacting the inner wall of the casing string during drilling operations. The disclosed embodiments may prove especially advantageous in applications where long lateral legs are being drilled.

Figure 1:
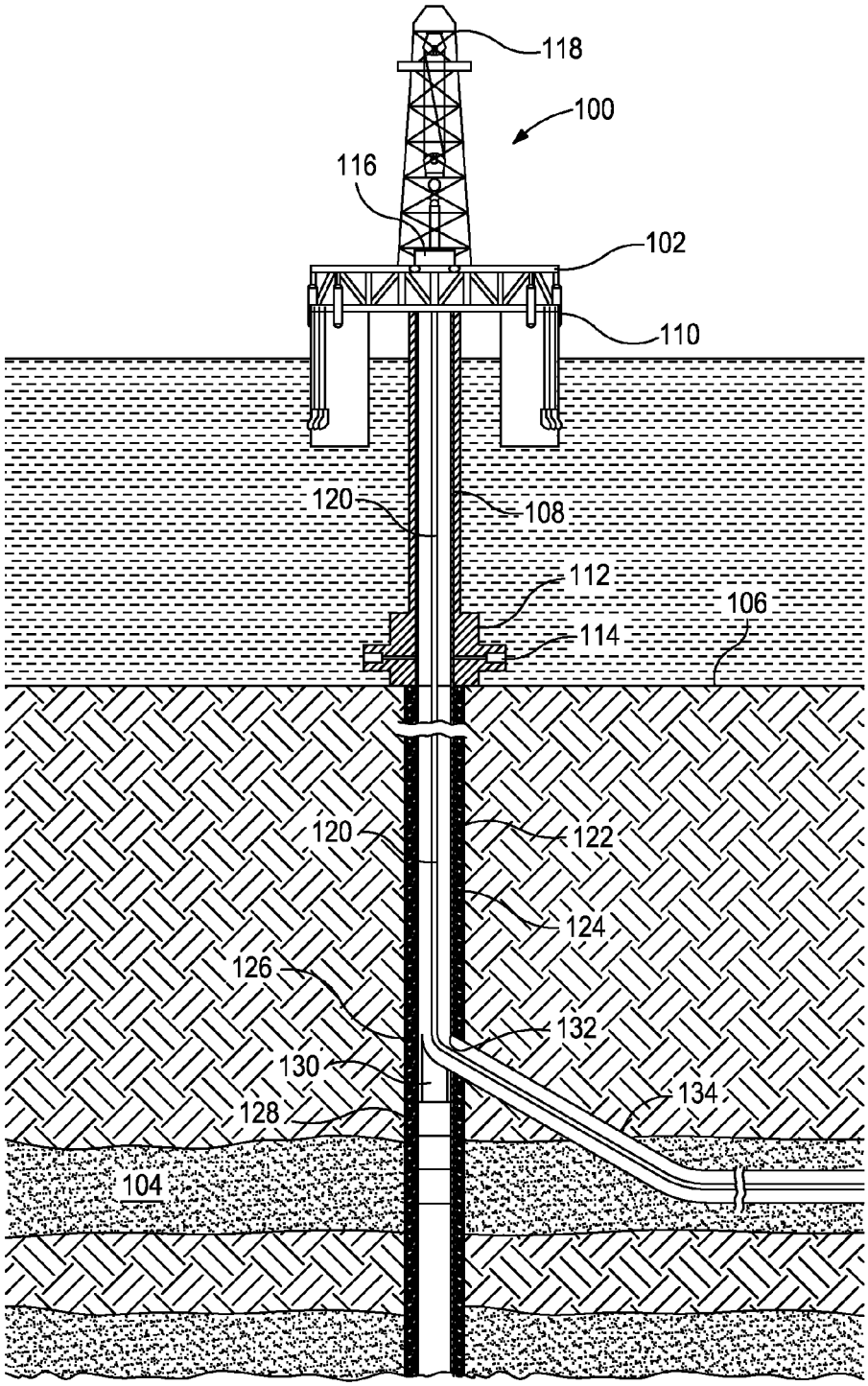
FIG. 1 illustrates an offshore oil and gas platform using an exemplary well system subassembly, according to one or more embodiments disclosed.

Referring to FIG. 1, illustrated is an offshore oil and gas platform 100 that uses an exemplary well system subassembly 128, according to one or more embodiments of the disclosure. Even though FIG. 1 depicts an offshore oil and gas platform 100, it will be appreciated by those skilled in the art that the exemplary well system subassembly 128, and its alternative embodiments disclosed herein, are equally well suited for use in or on other types of oil and gas rigs, such as land-based oil and gas rigs or any other location. The platform 100 may be a semi-submersible platform 102 centered over a submerged oil and gas formation 104 located below the sea floor 106. A subsea conduit 108 extends from the deck 110 of the platform 102 to a wellhead installation 112 including one or more blowout preventers 114. The platform 102 has a hoisting apparatus 116 and a derrick 118 for raising and lowering pipe strings, such as a drill string 120.

As depicted, a main wellbore 122 has been drilled through the various earth strata, including the formation 104. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 124 is at least partially cemented within the main wellbore 122. The term "casing" is used herein to designate a tubular string used to line a wellbore. Casing may actually be of the type known to those skilled in the art as "liner" and may be made of any material, such as steel or composite material and may be segmented or continuous, such as coiled tubing.

The well system subassembly 128 may be installed in or otherwise form part of the casing string 124. The subassembly 128 may include a casing joint 126 interconnected between elongate portions or lengths of the casing string 124. The well system subassembly 128 may further include a whipstock assembly 130 positioned within the casing string 124 and/or the casing joint 126. As will be described in greater detail below, the whipstock assembly 130 has a deflector surface that may be circumferentially oriented relative to the casing joint 126 such that a casing exit 132 can be milled, drilled, or otherwise formed in the casing joint 126 in a desired circumferential direction. As illustrated, the casing joint 126 is positioned at a desired intersection between the main wellbore 122 and a branch or lateral wellbore 134. The terms "branch" and "lateral" wellbore are used herein to designate a wellbore which is drilled outwardly from its intersection with another wellbore, such as a parent or main wellbore. Moreover, a branch or lateral wellbore may have another branch or lateral wellbore drilled outwardly therefrom.

It will be appreciated by those skilled in the art that even though FIG. 1 depicts a vertical section of the main wellbore 122, the present disclosure is equally applicable for use in wellbores having other directional configurations including horizontal wellbores, deviated wellbores, slanted wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
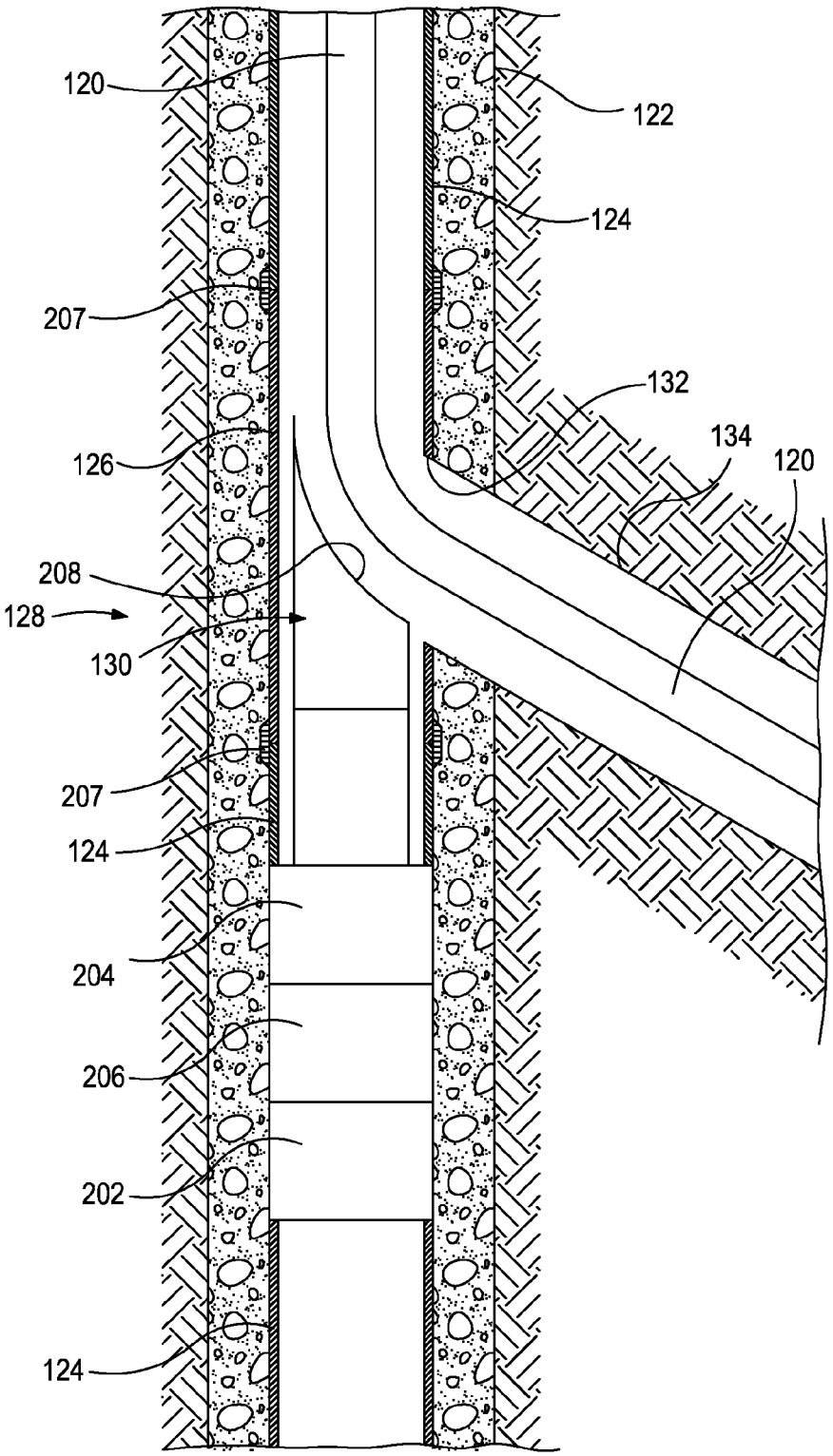
FIG. 2 illustrates an enlarged view of the well system subassembly of FIG. 1.

Referring now to FIG. 2, illustrated is an enlarged view of the exemplary well system subassembly 128, according to one or more embodiments. The well system subassembly 128 may include various tools and tubular lengths interconnected in order to form a portion of the casing string 124. For example, the subassembly 128 may include a latch coupling 202 having a profile and a plurality of circumferential alignment elements operable to receive a latch assembly therein and locate the latch assembly in a particular circumferential orientation. The subassembly 128 may also include an alignment bushing 204 having a longitudinal slot that is circumferentially referenced to the circumferential alignment elements of the latch coupling 202. Positioned between the latch coupling 202 and the alignment bushing 204 is a casing alignment sub 206 that is used to ensure proper alignment of the latch coupling 202 relative to the alignment bushing 204. It will be understood by those skilled in the art that the well system subassembly 128 may include a greater or lesser number of tools or a different set of tools that are operable to enable a determination of an offset angle between a circumferential reference element and a desired circumferential orientation of the casing exit 132.

The casing joint 126 may be coupled to and otherwise interposing separate elongate segments of the casing string 124. In some embodiments, each end of the casing joint 126 may be threaded to the corresponding elongate lengths of the casing string 124. In other embodiments, however, the casing joint 126 may be coupled to the casing string 124 via couplings 207 made of, for example, steel or a steel alloy (e.g., low alloy steel).

The casing joint 126 may be made of a softer material or otherwise a material that provides easy milling or drilling therethrough. In one or more embodiments, the casing joint 126 is made of aluminum or an aluminum alloy. In other embodiments, however, the casing joint 126 may be made of various composite materials such as, but not limited to, fiberglass, carbon fiber, combinations thereof, or the like. The use of composite materials for the casing joint 126 may prove advantageous since cuttings resulting from the milling of the casing exit 132 through the casing joint 126 will not produce magnetically-charged debris that could magnetically-bind with downhole metal components or otherwise be difficult to circulate out of the well.

In some embodiments, the whipstock assembly 130 may be coupled to or otherwise engage the latch coupling 202 through the use of a latch assembly (not shown) having an outer profile that is operable to engage an inner profile and circumferential alignment elements of the latch coupling 202. As illustrated, the whipstock assembly 130 may include a deflector surface 208 operable to direct a milling or drilling tool into the sidewall of the casing joint 126 to create the casing exit 132 therethrough.

Figure 3:
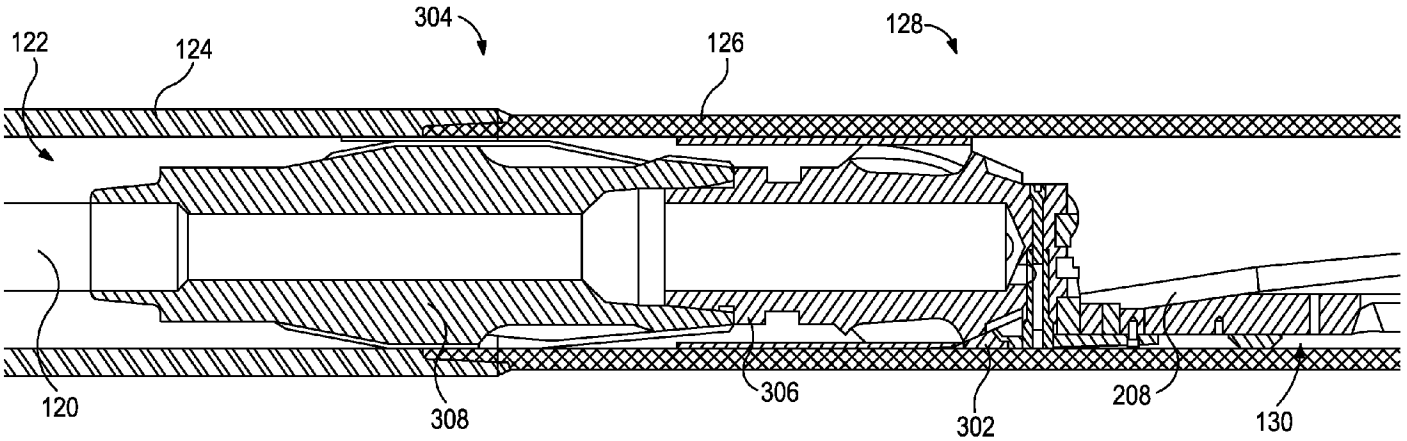
FIG. 3 illustrates a horizontal, cross-sectional view of the well system subassembly of FIG. 1, according to one or more embodiments disclosed.

Referring now to FIG. 3, illustrated is a horizontal view of a portion of the well system subassembly 128 before the casing exit 132 is formed or otherwise defined in the casing joint 126, according to one or more embodiments. As illustrated, a milling or drilling assembly 304 may be coupled to the end of the drill string 120 and extended into the main wellbore 122 until locating the whipstock assembly 130. The whipstock assembly 130 may be tapered from its downhole end (not shown) to an uphole tip 302 thereby defining the deflector surface 208. In operation, the deflector surface 208 is operable to direct the drilling assembly 304 in the desired circumferential orientation in order to form the casing exit 132 (FIG. 2) in the casing joint 126. As used herein, the term "drilling assembly" can refer to both milling and drilling assemblies, or refer to either assembly individually.

The drilling assembly 304 may include one or more mills, such as a first mill 306 and a second mill 308. It will be appreciated, however, that more or less than two mills 306, 308 may be used in the drilling assembly 304, without departing from the scope of the disclosure. The first mill 306 may be characterized as a lead mill having a partially tapered profile configured to engage and ride up the deflector surface 208 as the drilling assembly 304 advances within the casing joint 126. The second mill 308 may be axially spaced from the first mill 306 along the drill string 120 and be characterized as a watermelon mill having an outer diameter that is equal to or greater than the outer diameter of the first mill 306.

Figure 4:
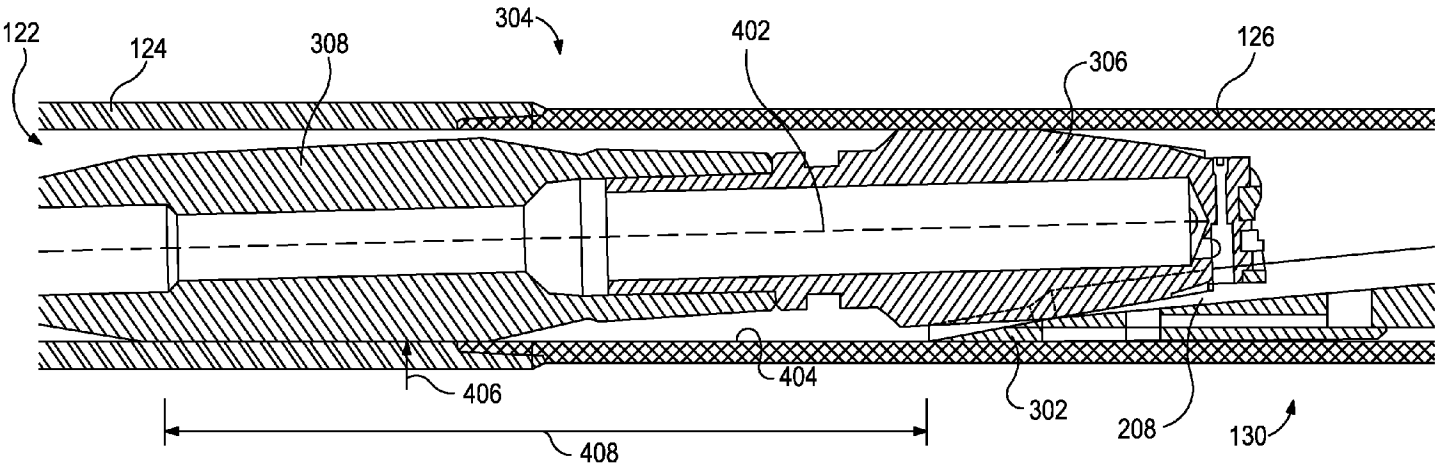
FIG. 4 illustrates another horizontal, cross-sectional view of the well system subassembly of FIG. 1 as a drilling assembly advances in the wellbore, according to one or more embodiments disclosed.

FIG. 4 shows the drilling assembly 304 as it advances within casing joint 126 and the first or lead mill 306 begins to climb the deflector surface 208 of the whipstock 130. As the lead mill 306 climbs the angled whipstock 130, the central axis 402 of the drilling assembly 304 is correspondingly angled such that portions of the drilling assembly 304 following the lead mill 306 are forced into contact with the lowside 404 of the casing joint 126. As used herein, the term "lowside" refers to the portion of the inner wall of the casing joint 126 (or casing string 124) that is located about 180° from the casing exit 132 (FIG. 2).

As illustrated, a point of contact 406 may be located or otherwise determined where the drilling assembly 304 generally contacts the lowside 404 of the casing joint 126. The point of contact 406 may be determined by knowing the angle of the deflector surface 208 with respect to the casing joint 126 and the corresponding diameters of the second mill 308 and the remaining portions of the drill string 120 (FIG. 3). In some embodiments, the point of contact 406 may apply to both the second mill 308 and the drill string 120 (FIG. 3) such that both the second mill 308 and the drill string 120 following the second mill 308 will respectively rotate and wear at or near the same point of contact 406 with the casing joint 126 as the drilling assembly 304 advances within the wellbore 122.

As illustrated, the uphole tip 302 of the whipstock 130 may be arranged along the axial length of the casing joint 126 and axially spaced from the casing string 124 by a first distance 408. In scenarios where the point of contact 406 falls within the first distance 408, the second mill 308 and succeeding drill string 120 may detrimentally wear against the lowside 404 of the casing joint 126. According to at least one embodiment disclosed herein, the damaging wear generated on the lowside 404 by the second mill 308 and succeeding drill string 120 may be eliminated by reducing the axial length of the first distance 408. By reducing the first distance 408, the point of contact 406 may fall outside of the first distance 408 and thereby be located at a point located within the casing string 124. As a result, the second mill 308 and succeeding drill string 120 will not wear against the soft material of the casing joint 126, but will instead wear against the harder material of the casing string 124 where the damaging wear will be less detrimental to the proper operation of the well system subassembly 128.

In some embodiments, the axial length of the first distance 408 may be reduced by installing or otherwise setting the whipstock assembly 130 in the casing joint 126 closer to the casing string 124. In other embodiments, the axial length of the first distance 408 may be reduced by simply reducing the overall length of the casing joint 126 such that the uphole tip 302 of the whipstock 130 is required to be closer to the casing string 124 by virtue of the shortened length and thereby locating the point of contact at a location falling within the casing string 124.

Figure 5A:
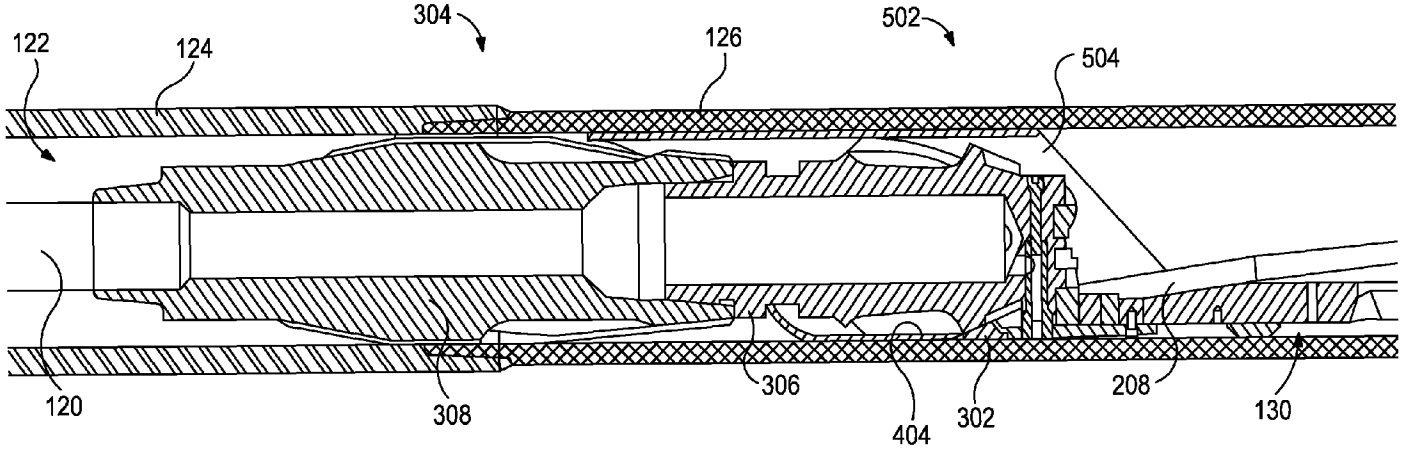
FIG. 5*a* illustrates another exemplary well system subassembly, according to one or more embodiments disclosed.

Referring now to FIG. 5*a*, illustrated is another exemplary well system subassembly 502, according to one or more embodiments disclosed. The subassembly 502 may be similar in several respects to the well system subassembly 128 described above with reference to FIGS. 2 and 3. Accordingly, the subassembly 502 of FIG. 5*a* may be best understood with reference to FIGS. 2 and 3, where like numerals indicate like components that will not be described again in detail. Similar to the well system subassembly 128 described with reference to FIGS. 2 and 3, the well system subassembly 502 may be configured to not only divert a drilling assembly 304 such that one or more mills 306, 308 are able to mill out a casing exit 132 (FIG. 2) for the subsequent formation of a lateral borehole 134, but also protect the lowside 404 of the casing joint 126 (or casing string 124, when applicable) from damaging wear by the rotating drilling assembly 304.

As illustrated, the well system subassembly 502 may include a wear sleeve 504 extending axially from the whipstock assembly 130. In some embodiments, the wear sleeve 504 may be coupled or attached to the whipstock assembly 130 with attachment methods such as, but not limited to, mechanical fasteners, welding techniques, brazing techniques, adhesives, combinations thereof, or the like. In other embodiments, however, the wear sleeve 504 may be formed as an integral portion or extension of the whipstock 130 itself. Advantageously, the wear sleeve 504 is coupled directly to the whipstock assembly 130, thereby being run into the main wellbore 122 along with the remaining components of the whipstock assembly 130.

Figure 5B:
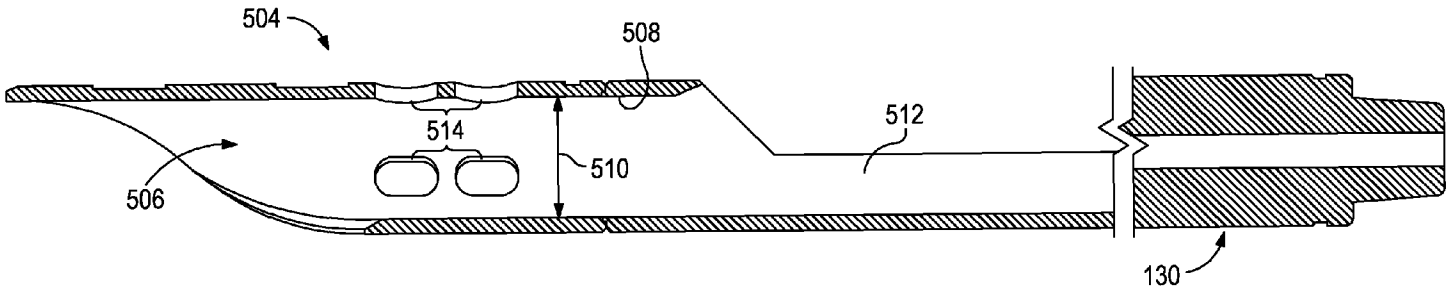
FIG. 5*b* illustrates an exemplary wear sleeve that can be used in conjunction with the well system subassembly of FIG. 5*a*, according to one or more embodiments.

Referring to FIG. 5*b*, with continued reference to FIG. 5*a*, illustrated is a cross-sectional view of the exemplary wear sleeve 504 as extending from the whipstock 130, according to one or more embodiments. Without the wear sleeve 504, the whipstock 130 is essentially a cylinder cut into a wedge shape where the deflector surface 208 defines a chute for the drilling assembly 304 to engage and ride up on. With the wear sleeve 504, however, the whipstock 130 may provide a throat 506 at its uphole end configured to receive the drilling assembly 304 as it advances in the main wellbore 122. The throat 506 may extend axially along the length of the wear sleeve 504 and transition gradually into the deflector surface 208 (FIG. 5*a*) of the whipstock 130.

The wear sleeve 504 may be made of a hard material (e.g., stainless steel or other steel alloys) or hardened through methods such as heat treating or hard coatings, such as ceramics, and/or may be made of the same material as the whipstock 130. Moreover, the wear sleeve 504 may have an axial length that extends beyond or otherwise across the point of contact 406 (FIG. 4) such that the drilling assembly 304 will engage the throat 506 as it advances in the wellbore 122, and not the lowside 404 of the casing joint 126. Consequently, the wear sleeve 504 may be configured to protect the soft material of the casing joint 126 from damaging wear caused by the drilling assembly 304.

In one or more embodiments, as illustrated, the wear sleeve 504 may provide or otherwise define a cylindrical sleeve 508 that circumferentially encloses the throat 506 along a portion of the axial length of the wear sleeve 504. The cylindrical sleeve 508 may have an inner diameter 510 large enough to not only protect the casing joint 126 (or casing string 124, when applicable) in the area of the uphole tip 302, but also allow for the milling assembly 304 to pass therethrough, unobstructed. In some embodiments, however, the inner diameter 510 may be sized such that the second mill 308 is required to mill away a portion of the cylindrical sleeve 508 in order to allow the milling assembly 304 to properly pass therethrough.

In other embodiments, the cylindrical sleeve 508 may be omitted and the wear sleeve 504 may instead provide an arcuate member 512 that forms an elongate chute along the axial length of the wear sleeve 504. The arcuate member 512 may be configured to extend only partially about the inner surface of the casing joint 126 and, with the throat 506, transition gradually into the deflector surface 208 (FIG. 5*a*) of the whipstock 130. In some embodiments, the arcuate member 512 may extend arcuately between about 15° and about 200° about the inner circumferential surface of the casing joint 126 (or casing string 124, when applicable). Other angular configurations for the arcuate member 512, however, may be used, without departing from the scope of the disclosure.

The wear sleeve 504 may further define one or more apertures 514 defined about its circumference. In operation, the apertures 514 may provide a location where a hydraulic tool, or the like, can latch onto the whipstock 130. The hydraulic tool may be used to initially run the whipstock 130 into the well and subsequently retrieve the whipstock 130 when milling and drilling operations are complete.

Figure 6:
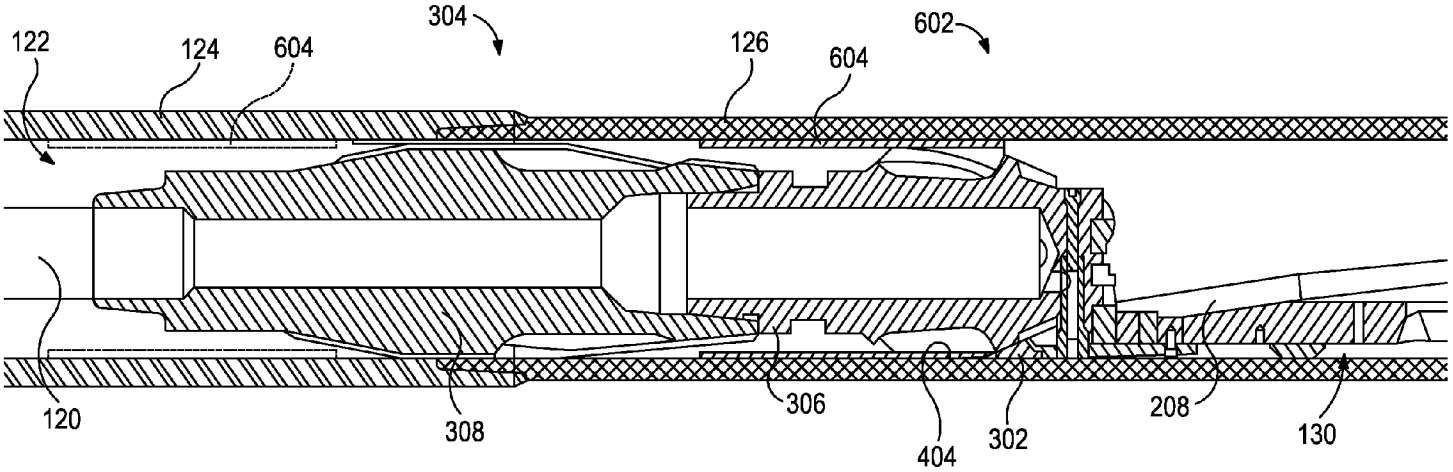
FIG. 6 illustrates another exemplary well system subassembly, according to one or more embodiments disclosed.

Referring now to FIG. 6, illustrated is another exemplary well system subassembly 602, according to one or more embodiments disclosed. The subassembly 602 may be similar in several respects to the well system subassembly 128 described above with reference to FIGS. 2 and 3 and therefore may be best understood with reference thereto, where like numerals indicate like components not described again. As illustrated, the well system subassembly 602 may include a wear bushing 604 configured to protect the lowside 404 of the casing joint 126 (or casing string 124, when applicable) from damaging wear by the rotating drilling assembly 304. To accomplish this, the wear bushing 604 may be made of a hard material (e.g., stainless steel or other steel alloys) or hardened through heat treatment or applications of hard coatings, such as a material that is harder than that of the casing joint 126, and/or may be made of the same material that the whipstock 130 is made out of.

In some embodiments, the wear bushing 604 may be an elongate cylinder of varying length, where the length depends on the application and the eventual location of the point of contact 406 (FIG. 4). In one or more embodiments, the wear bushing 604 may be run into the main wellbore 122 as part of the drilling assembly 304 and be detached therefrom once coming into contact with a stationary wellbore object or "no-go" point, such as the uphole tip 302 of the whipstock assembly 130 or the casing exit 132 (FIGS. 1 and 2). Accordingly, during operation after being appropriately detached from the drilling assembly 304, the wear bushing 604 may freely rotate within the main wellbore 122 and not be locked rotationally to the drilling assembly 304, nor locked rotationally to the casing joint 126 (or casing string 124, when applicable).

In at least one embodiment, the wear bushing 604 may be coupled to the outer diameter or outer extent of the lead mill 306 using, for example, one or more shear pins, shear rings, mechanical fasteners, etc. While not illustrated herein, those skilled in the art will readily recognize that the wear bushing 604 may equally be coupled to the outer diameter or outer extent of the second mill 308, without departing from the scope of the disclosure. Once the wear bushing 604 contacts the uphole tip 302, or another "no-go" point, the shear pins/rings, mechanical fasteners, etc. may be configured to release or otherwise break, thereby freeing the wear bushing 604 and allowing it to provide wear protection along its axial length.

In some embodiments, the inner diameter of the wear bushing 604 may be less than the outer diameter of the second mill 308. Consequently, the second mill 308 may be used to completely mill up the wear bushing 604 as the drilling assembly 304 advances downhole. In other embodiments, however, the second mill 308 may be configured to mill the inner diameter of the wear bushing 604 to a diameter sufficient for the second mill 308 and succeeding drill string 120 to pass therethrough. Moreover, the wear bushing 604 may have an inner diameter less than the outer diameter of the whipstock assembly 130, even after being optionally milled to a larger inner diameter with the second mill 308. Consequently, upon removing the whipstock assembly 130 from the main wellbore 122, the whipstock assembly 130 may be configured to force or otherwise carry the wear bushing 604 out of the main wellbore 122 also.

In other embodiments, the wear bushing 604 may be threaded to the outer diameter or extent of the first and/or second mills 306, 308. Once the wear bushing 604 contacts the uphole tip 302, or another "no-go" point, and the drilling assembly 304 continues to rotate, the initial resistance to rotation may serve to un-thread the wear bushing 604 from the drilling assembly 304, thereby allowing it to float on the drill string 120 and provide wear protection. Drill strings 120 are typically rotated to the right (i.e., clockwise) when milling since drill pipe typically has right hand threads. Accordingly, the wear bushing 604 may be configured with left hand threads such that it would loosen and un-thread as the drilling assembly 304 is rotated to the right. Again, the wear bushing 604 may have an inner diameter less than the outer diameter of the whipstock assembly 130. Consequently, upon removing the whipstock assembly 130 from the main wellbore 122, the wear bushing 604 may be forced or carried out of the main wellbore 122 also.

In yet other embodiments, the wear bushing 604 (shown in dashed lines) may be coupled to the drilling assembly 304 uphole from the second mill 308 using, for example, one or more shear pins, shear rings, mechanical fasteners, etc. Again, once the wear bushing 604 contacts the uphole tip 302, or another "no-go" point, the shear pins/rings, mechanical fasteners, etc. may be configured to release or otherwise break, thereby freeing the wear bushing 604 and allowing it to provide wear protection along its axial length. The wear bushing 604 in said embodiment may be particularly useful in protecting not only the casing joint 126 from wear, but also the casing string 124. This may prove advantageous in applications where long lateral wellbores are being drilled and the drill string 120 rides and wears on the casing string 124 over long periods of time. The wear bushing 604 in said embodiment may further exhibit an inner diameter smaller than the maximum outer diameter of one or both of the mills 306, 308. Consequently, when the drilling assembly 304 is pulled out of the main wellbore 122, the wear bushing 604 may be forced out of the main wellbore 122 also.

As can be appreciated, the wear bushing 604 may be run into the main wellbore 122 via various other means or techniques. For example, the wear bushing 604 could be run as part of the casing exit 132 assembly, or with the original drilling assembly in order to protect the main wellbore 122 below the casing exit 132 as the drilling assembly 304 drills the parent borehole deeper, and prior to the insertion of the whipstock assembly. In operation, the wear bushing 604 acts as a bearing and therefore reduces friction.

Figure 7:
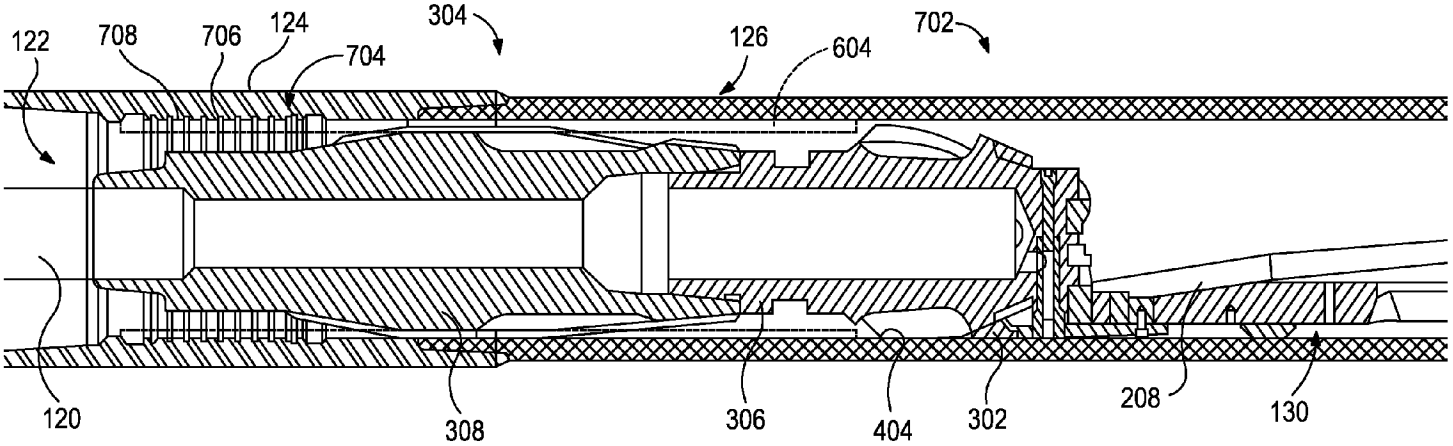
FIG. 7 illustrates another exemplary well system subassembly, according to one or more embodiments disclosed.

Referring now to FIG. 7, illustrated is another exemplary well system subassembly 702, according to one or more embodiments disclosed. The subassembly 702 may be similar in several respects to the well system subassemblies 128 and 602 described above with reference to FIGS. 2, 3, and 6 and therefore may be best understood with reference thereto, where like numerals indicate like components not described again. Similar to the well system subassembly 602, the well system subassembly 702 may include a wear bushing 604 (shown in dashed) configured to protect the lowside 404 of the casing joint 126 (or casing string 124, when applicable) from damaging wear by the rotating drilling assembly 304 (i.e., including the drill string 120). Also similar to the well system subassembly 602, the wear bushing 604 may be run into the main wellbore 122 by being coupled to any component of the drilling assembly 304 and removably detached therefrom via the several detachment processes described above with reference to FIG. 6.

Unlike the well system subassembly 602, however, the well system subassembly 702 may include a coupling 704 such as, but not limited to a latch coupling or depth reference coupling, as known in the art. In some embodiments, as illustrated, the coupling 704 may be formed or otherwise defined on the inner surface of the casing string 124. In other embodiments, however, the coupling 704 may be formed or otherwise defined on the inner surface of the casing joint 126, without departing from the scope of the disclosure. As described below, the coupling 704 may be characterized as a stationary wellbore object or "no-go" point as it interacts with the wear bushing 604.

The coupling 704 may have a unique machine coupling profile 706 configured to match a corresponding unique machine bushing profile 708 defined on the outer surface of the wear bushing 604. Accordingly, as the wear bushing 604 is run into the main wellbore 122, the coupling and bushing profiles 706, 708 may locate each other and thereby be able to set the wear bushing 604 in its proper place. In some embodiments, for example, the wear bushing 604 may be a snap ring device capable of expanding into the coupling 704 once the corresponding profiles 706, 708 are mutually located and engaged.

Since the coupling 704 may be formed or otherwise defined in the casing string or joint 124, 126 at a known depth within the main wellbore 122, the wear bushing 604 may be designed and installed such that it extends across the point of contact 406 (FIG. 4) and thereby prevents damaging wear from occurring on the lowside of the casing joint 126 (or casing string 124, where applicable). Advantageously, the use of the coupling 704 helps ensure that the wear bushing 604 is located in the ideal location relative to the uphole tip 302 of the whipstock 130. Moreover, the wear bushing 604 may have an inner diameter less than the outer diameter of either the whipstock assembly 130 or one or more of the components of the drilling assembly 304. Consequently, upon removing the whipstock assembly 130 or the drilling assembly from the main wellbore 122, the wear bushing 604 may be forced out of engagement with the coupling 704 and thereafter removed from the main wellbore 122 also.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A well system subassembly, comprising:

a casing joint coupled to a casing string and defining a lowside therein, the casing joint being made of a first material that is softer than that of the casing string;

a whipstock assembly arranged within the casing joint and having a deflector surface operable to direct a drilling assembly into a sidewall of the casing joint to create a casing exit; and a wear sleeve coupled to and extending axially from the whipstock assembly, the wear sleeve defining a throat that extends along an axial length of the wear sleeve and transitions into the deflector surface, wherein the axial length of the wear sleeve extends across a point of contact where the drilling assembly would otherwise engage the lowside of the casing joint, whereby the wear sleeve protects the lowside of the casing joint from wear caused by the drilling assembly.

2. The subassembly of claim 1, wherein the first material is aluminum.

3. The subassembly of claim 1, wherein the wear sleeve is made of a second material that is harder than the first material.

4. The subassembly of claim 1, wherein the wear sleeve is formed as an integral extension of the whipstock assembly.

5. The subassembly of claim 1, wherein the wear sleeve defines a cylindrical sleeve that circumferentially encloses the throat along a portion of the axial length of the wear sleeve.

6. The subassembly of claim 1, wherein the wear sleeve defines an elongate, arcuate member that extends partially circumferentially about an inner surface of the casing joint.

7. A method for protecting a lowside of a casing joint coupled to a casing string, comprising:

arranging within the casing joint a whipstock assembly having a deflector surface, the casing joint being made of a material that is softer than that of the casing string;

arranging a wear sleeve axially adjacent and coupled to the whipstock assembly, the wear sleeve defining a throat that extends along an axial length of the wear sleeve and transitions into the deflector surface;

directing with the throat and deflector surface a drilling assembly into a sidewall of the casing joint to create a casing exit within the casing joint; and protecting with the wear sleeve the lowside of the casing joint from wear caused by the drilling assembly as the drilling assembly rotates, the axial length of the wear sleeve extending across a point of contact where the drilling assembly would otherwise engage the lowside.

8. The method of claim 7, further comprising advancing the drilling assembly through a cylindrical sleeve defined by the wear sleeve, the cylindrical sleeve circumferentially enclosing the throat along a portion of the axial length of the wear sleeve.

9. The method of claim 7, further comprising advancing the drilling assembly over an elongate, arcuate member defined by the wear sleeve, the arcuate member extending partially circumferentially about an inner surface of the casing joint.

10. A well system subassembly, comprising:

a casing joint coupled to a casing string and defining a lowside therein, the casing joint being made of a first material that is softer than that of the casing string;

a whipstock assembly arranged within the casing joint and having an uphole tip and a deflector surface operable to direct a drilling assembly into a sidewall of the casing joint to create a casing exit; and a wear bushing coupled to the drilling assembly and removable from the drilling assembly upon engaging a stationary wellbore object, the wear bushing being configured to protect the lowside of the casing joint from damaging wear caused by the drill string assembly.

11. The subassembly of claim 10, wherein the first material is one of aluminum, an aluminum alloy, fiberglass, and carbon fiber.

12. The subassembly of claim 10, wherein the wear bushing is made of a second material that is harder than the first material.

13. The subassembly of claim 10, wherein the drilling assembly is coupled to and includes a drill string and comprises a first mill and a second mill axially spaced from the first mill.

14. The subassembly of claim 13, wherein the wear bushing is coupled to an outer diameter of the first mill.

15. The subassembly of claim 13, wherein the wear bushing is coupled to an outer diameter of the second mill.

16. The subassembly of claim 13, wherein the wear bushing is threaded to an outer diameter of one of the first or second mills.

17. The subassembly of claim 13, wherein the wear bushing is coupled to the drilling assembly uphole from the second mill.

18. The subassembly of claim 10, wherein the stationary wellbore object is a coupling defined on an inner surface of the casing string, the coupling having a coupling profile configured to match a wear bushing profile defined on an outer surface of the wear bushing, wherein as the wear bushing is run, the coupling and wear bushing profiles are configured to interact and thereby disengage the wear bushing from the drilling assembly.

19. The subassembly of claim 13, wherein the wear bushing has an axial length that extends across a point of contact where the drilling assembly would otherwise engage the lowside.

20. A method for protecting a lowside of a casing joint coupled to a casing string, comprising:

arranging within the casing joint a whipstock assembly having an uphole tip and a deflector surface, the casing joint being made of a material that is softer than that of the casing string;

advancing a drilling assembly within the casing string, the drilling assembly having a wear bushing coupled thereto;

disengaging the wear bushing from the drilling assembly by contacting the wear bushing with a stationary wellbore object;

directing with the deflector surface a drilling assembly into a sidewall of the casing joint to create a casing exit within the casing joint; and protecting with the wear bushing the lowside of the casing joint from wear caused by the drilling assembly as the drilling assembly rotates, the wear bushing having an axial length that extends across a point of contact where the drilling assembly would otherwise engage the lowside.

21. The method of claim 20, wherein the stationary wellbore object is the uphole tip.

22. The method of claim 20, wherein the stationary wellbore object is a coupling defined on an inner surface of the casing string and defining a coupling profile, and wherein disengaging the wear bushing from the drilling assembly further comprises matching the coupling profile with a wear bushing profile defined on an outer surface of the wear bushing.

23. The method of claim 20, wherein arranging within the casing joint the whipstock assembly further comprises arranging the whipstock assembly such the point of contact lies within the casing string.

* * * * *